United States Patent [19]

Perné et al.

[11] 4,264,022

[45] Apr. 28, 1981

[54] STOPPERS WITH POURING LIP

[75] Inventors: Raymond Perné, Morancé; Philippe Odet, Saint Georges de Reneins, both of France

[73] Assignee: Astra Plastique, Georges de Reneins, France

[21] Appl. No.: 92,301

[22] Filed: Nov. 8, 1979

[30] Foreign Application Priority Data

Nov. 21, 1978 [FR] France ..... 78 33362

[51] Int. Cl.[3] ..... B65D 25/48

[52] U.S. Cl. ..... 222/547; 222/570

[58] Field of Search ..... 222/547, 478, 479, 481, 222/488, 564, 566, 567, 570

[56] References Cited

U.S. PATENT DOCUMENTS

| | | | |
|---|---|---|---|
| 2,759,643 | 8/1956 | Dahlin | 222/547 X |
| 3,311,275 | 3/1967 | Gibson | 222/564 X |
| 3,330,450 | 7/1967 | Clare | 222/479 |
| 3,762,612 | 10/1973 | Miller | 222/547 X |
| 3,980,211 | 9/1976 | Owens | 222/478 |

*Primary Examiner*—Allen N. Knowles

*Attorney, Agent, or Firm*—Dowell & Dowell

[57] ABSTRACT

The present invention relates to a stopper having a sleeve with pouring lip for bottles and like receptacles with necks. Inside the sleeve is provided a transverse disc supported on spaced apart arms join to a perforated annular partition supporting the sleeve. When the liquid is poured out, it is guided between the periphery of the disc and the sleeve, at the same time that air is inducted through the upper openings of the perforated zone. The invention finds particular application in the stoppering industry.

3 Claims, 1 Drawing Figure

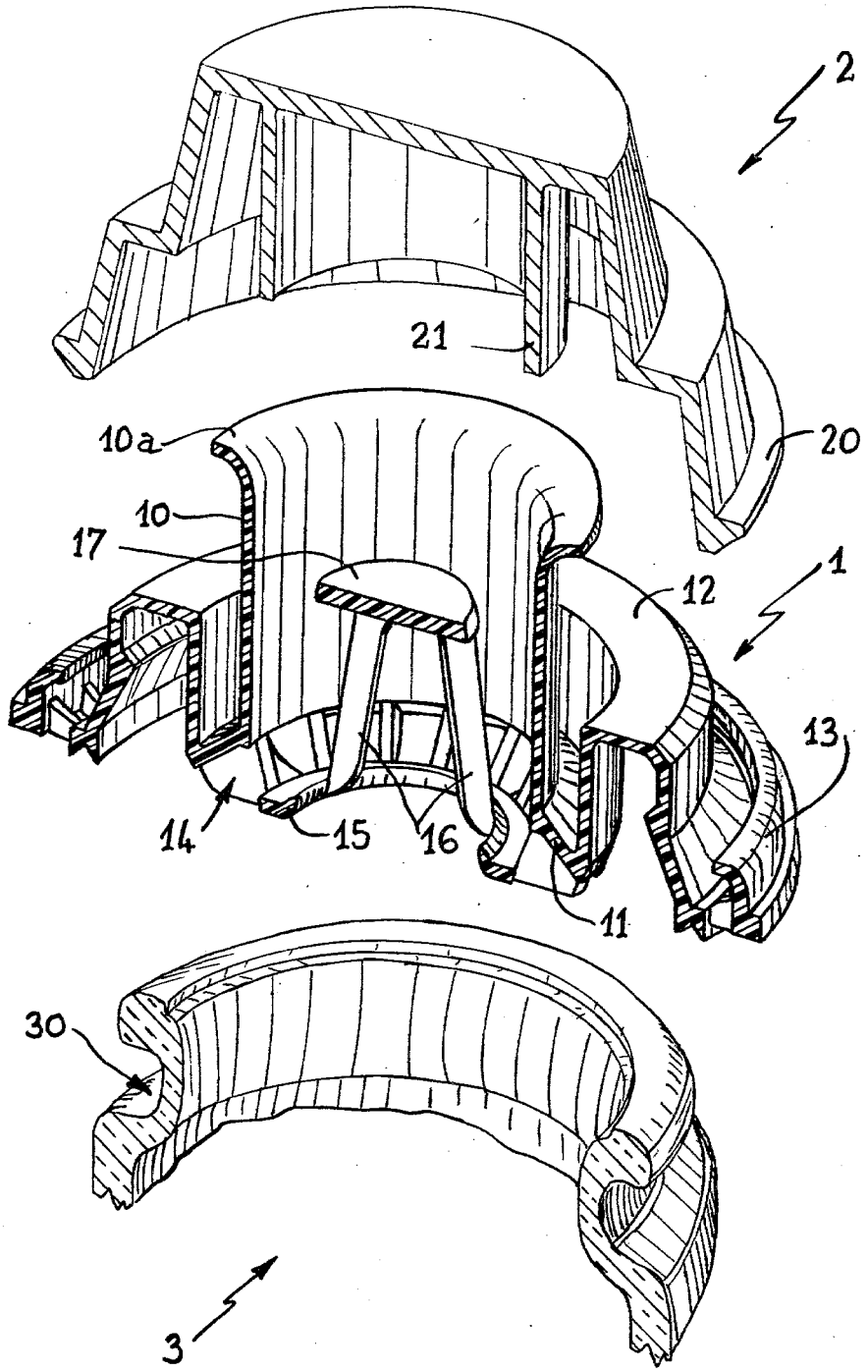
2
21
20
10a
10
17
12
1
13
14
15
16
11
30
3

STOPPERS WITH POURING LIP

The present invention relates to stoppers with pouring lip adapted to be fixed on the neck of bottles or like receptacles, with a view to stoppering same whilst making it easier to pour out the contents thereof.

It is known that, in their conventional form, stoppers of this type generally comprise a body arranged so as to be retained in tight manner on the open end of a bottle neck, and a removable cap adapted to close the opening of said body. This body usually supports a cylindrical sleeve which covers or extends the top of the inner wall of the neck and which goes beyond said wall and flares radially outwardly in the form of a pouring lip. With this lip are associated inner means (partition, spider, transverse disc, perforations, etc.) adapted to guide the liquid when it is poured out and to promote the inlet of air into the receptacle.

The particular purpose of the improvements forming the subject matter of the present invention is to allow a stopper with pouring lip of the above-mentioned type to be produced, which works particularly satisfactorily whilst remaining simple and economical to manufacture.

The stopper with pouring lip according to the invention, is of the type comprising a body adapted to be fixed to the neck of the receptacle and provided with a pouring lip formed by a cylindrical sleeve which encloses a transverse disc with an annular clearance adapted to allow the liquid to pass through. The transverse disc is joined, by substantially vertical arms, to the lower part of the said sleeve, characterised in that the arms are joined to the lower part by a perforated annular partition zone oriented obliquely downwardly in the direction of the axis of said sleeve, the projecting inwardly into the bottle from the stopper base thereof, so as to determine a sort of barrier for the liquid when it flows, whilst allowing air to enter the receptacle.

The invention will be more readily understood on reading the following description with reference to the accompanying drawings, in which:

The single FIGURE shows in an exploded view illustrated in axial section the general arrangement of a stopper with pouring lip according to the invention oriented between a cap and the neck of the corresponding bottle.

Referring now to the drawing, the stopper shown therein comprises, in manner known per se, a main body 1 made of supple synthetic material shaped by molding, and a cap 2 made of a rigid plastics material. The body 1 is adapted to be fixed on the upper, open part of the neck 3 of a bottle.

The body 1 comprises a cylindrical sleeve 10 disposed axially and provided at its top with an outwardly flared edge 10*a*, so as to form a pouring lip. The base of this sleeve or lip 10 is joined by a annular partition 11, which is obliquely oriented downwardly and outwardly, to an annular stirrup shaped member 12 adapted to clip elastically in a groove 30 in the upper edge of the neck 3 of the bottle. Also associated with the stirrup shaped member 12 is a tear-off "guarantee" strip 13 arranged so as to retain the base 20 of the cap 2, thus guaranteeing the contents of the bottle until it is first used. The transverse top of this cap 2 is joined with an axial funnel member 21 adapted to engage tightly in the lip 10.

The base of the pouring lip 10 is joined, on the other side of the above-mentioned partition 11, to a perforated annular zone 14 which is obliquely oriented downwardly and inwardly. The lower edge of the openings of this zone 14 is formed by a ring 15 joined with three upwardly extending arms 16 which converge in the direction of the lower face of a disc 17 which is integral therewith. The disc 17, which is circular in the embodiment in question, has a diameter smaller than the inner diameter of the sleeve 10.

It should be noted that the stopper assembly may easily be obtained by molding in one piece, the matter being injected from the transverse disc 17.

The functioning of the above-described stopper with pouring lip readily follows from the foregoing explanations.

When the bottle is tilted to pour out the contents, after the strip 13 has been torn off and the cap 2 removed, the liquid, guided by the oblique partition 11, encounters the perforated zone 14 which it scarcely passes through. Most of this liquid passes over the lower ring 15 and, guided by the convergent arms 16, is obliged to flow through the annular space between the periphery of the disc 17 and the inner wall of the pouring lip 10. Tests and studies have shown that the liquid tends to flow with a cross section corresponding to a portion of ring, thus facilitating flow and promoting the inlet of air in the bottle through one or more of the openings of the perforated zone 14 above the surface of the liquid being poured.

In this way, a smooth flow of liquid is obtained, as well as an inlet of air characterized by an uninterrupted succession of small bubbles, this being so whatever the level of the liquid in the bottle. The flow is not jerky. It will be noted that the induction of the air bubbles is promoted by the oblique profile of the annular zone 14, which define a series of gaps forming guides.

The openings made in the annular perforated zone 14 may be of any number and profile. The same applies to the connecting arms 16 which may in certain cases be profiled to define a sort of helix. The disc 17 may present an elliptic profile when it is desired to obtain, momentarily, a reduced rate of flow by rotating the bottle or like receptacle about its axis while pouring.

It will further be noted that the invention may advantageously be used for making stoppers with a sliding pouring lip, of the type used in particular in combination with tins of mineral oil and the like.

What is claimed is:

1. A stopper for a receptacle having a neck, the stopper comprising:

(a) a body having annular means which surrounds the neck and secures the stopper thereto:

(b) a cylindrical sleeve defining a passage extending longitudinally of the stopper and passing through the body and having a pouring lip around one end;

(c) an annular partition supported on its outer periphery by the body and having an inner periphery joined to and supporting the other end of the sleeve;

(d) a perforated annular member supported by said partition and extending further into the receptacle therefrom and extending inwardly from the partition to form a barrier partially restricting the passage through the sleeve;

(e) arm means respectively disposed longitudinally of the stopper and extending partially through the passage of the sleeve toward said pouring lip; and (f) a disc supported on the arm means and disposed transversely across the passage inside the sleeve, the disc being of diameter less than the diameter of said passage.

2. The stopper as claimed in claim 1, wherein said perforated annular member comprises a ring, and the arm means comprise multiple arms which have ends located remotely from the disc and secured to said ring.

3. The stopper as claimed in claim 1, wherein said annular means of the body which surrounds the neck of the receptacle further comprises an annular stirrup shaped member for receiving the neck and clipping thereto, the stirrup shaped member supporting the outer periphery of said annular partition, and said partition extending from the stirrup shaped member away from the perforated annular member and obliquely toward and joining said other end of the sleeve.

* * * * *